US010883200B2

(12) United States Patent
Nomura et al.

(10) Patent No.: US 10,883,200 B2
(45) Date of Patent: Jan. 5, 2021

(54) APPARATUS FOR THERMALLY-STABILIZING CARBON MATERIAL PRECURSOR AND METHOD FOR THERMALLY-STABILIZING CARBON MATERIAL PRECURSOR USING THE SAME

(71) Applicant: KABUSHIKI KAISHA TOYOTA CHUO KENKYUSHO, Nagakute (JP)

(72) Inventors: Kazuhiro Nomura, Nagakute (JP); Takuya Morishita, Nagakute (JP)

(73) Assignee: KABUSHIKI KAISHA TOYOTA CHUO KENKYUSHO, Nagakute (JP)

( * ) Notice: Subject to any disclaimer, the term of this patent is extended or adjusted under 35 U.S.C. 154(b) by 138 days.

(21) Appl. No.: 16/381,293

(22) Filed: Apr. 11, 2019

(65) Prior Publication Data

US 2019/0360127 A1 Nov. 28, 2019

(30) Foreign Application Priority Data

May 25, 2018 (JP) ..... 2018-100856

(51) Int. Cl.

| | |
|---|---|
| ***D01F 9/32*** | (2006.01) |
| ***D01F 9/22*** | (2006.01) |
| ***F27D 21/00*** | (2006.01) |
| ***F27B 17/00*** | (2006.01) |
| ***F27D 19/00*** | (2006.01) |

(52) U.S. Cl.

CPC ..... *D01F 9/32* (2013.01); *D01F 9/225* (2013.01); *F27D 21/0014* (2013.01); *F27B 17/00* (2013.01); *F27D 2019/0012* (2013.01)

(58) Field of Classification Search

CPC ..... D01F 9/32; D01F 9/225; F24D 21/0014; B01J 20/28023; C03B 2205/72

USPC ..... 432/4

See application file for complete search history.

(56) References Cited

U.S. PATENT DOCUMENTS 5,819,350 A * 10/1998 Wang ..... B01J 20/20 8/149.3
10,604,871 B2 * 3/2020 Tada ..... D01F 9/21

FOREIGN PATENT DOCUMENTS

JP 2003-113538 A 4/2003
JP 2009-138313 A 6/2009

* cited by examiner

*Primary Examiner* — Vivek K Shirsat
(74) *Attorney, Agent, or Firm* — Oliff PLC

(57) ABSTRACT

An apparatus for thermally-stabilizing a carbon material precursor having a heating apparatus which thermally-stabilizes a carbon material precursor, a thermometer for measuring a temperature in the heating apparatus, a water vapor concentration meter for measuring a concentration of water vapor in the heating apparatus, and a batch type thermal-stabilization apparatus for feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

6 Claims, 5 Drawing Sheets

APPARATUS FOR THERMALLY-STABILIZING CARBON MATERIAL PRECURSOR AND METHOD FOR THERMALLY-STABILIZING CARBON MATERIAL PRECURSOR USING THE SAME

BACKGROUND OF THE INVENTION

Field of the Invention

The present invention relates to an apparatus for thermally-stabilizing (flameproofing) a carbon material precursor and a method for thermally-stabilizing a carbon material precursor using the same.

Related Background Art

A main conventionally employed method for producing carbon fibers, which are a type of carbon material, is a method for thermally-stabilizing and then carbonizing a carbon fiber precursor obtained by spinning polyacrylonitrile. Examples of methods for controlling the thermal-stabilization conditions in such a method for producing carbon fibers include a control method based on the density of fiber bundles (Japanese Unexamined Patent Application Publication No. 2009-138313 (PTL 1)) and a control method based on the concentration of ammonia in the thermal-stabilization furnace (Japanese Unexamined Patent Application Publication No. 2003-113538 (PTL 2)).

However, since the variational behavior of the density of fiber bundles at the time of thermally-stabilizing treatment differs depending on the type of carbon fiber precursor, it has been difficult to apply the control conditions in the method for thermally-stabilizing fiber bundles of an acrylonitrile-based precursor to the method for thermally-stabilizing fiber bundles of a precursor of different type without any change.

In addition, the generation behavior of ammonia at the time of thermally-stabilizing treatment also differs depending on the type of carbon fiber precursor. For example, in the thermally-stabilizing treatment of a carbon material precursor formed of an acrylonitrile-based polymer, the acrylonitrile-based polymer thermally decomposes to generate ammonia when the thermal-stabilization reaction runs away. Thus, the concentration of this ammonia can be used as an index to control the thermal-stabilization temperature. Meanwhile, in the thermally-stabilizing treatment of a carbon material precursor formed of an acrylamide-based polymer, a deammoniation reaction proceeds as a side reaction and thus ammonia is inevitably generated. Therefore, it has been difficult to control the thermal-stabilization temperature by using the concentration of ammonia as an index.

SUMMARY OF THE INVENTION

The present invention has been made in view of the above problems of the conventional art, and an object thereof is to provide an apparatus for thermally-stabilizing a carbon material precursor and a method for thermally-stabilizing a carbon material precursor using the same which make it possible to control the thermal-stabilization temperature of a carbon material precursor by introducing a new index, which thus make it possible to obtain a thermally-stabilized product (carbon material precursor subjected to thermally-stabilizing treatment) excellent in heat resistance, and which make it possible to produce a carbon material in a high yield.

The present inventors have made earnest studies to achieve the above object and found as a result that it is possible to obtain a thermally-stabilized product (carbon material precursor subjected to thermally-stabilizing treatment) excellent in heat resistance and to produce a carbon material in a high yield when the concentration of water vapor is used as an index to control the thermal-stabilization temperature of the carbon material precursor such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction. The above finding has led to the completion of the present invention.

Specifically, an apparatus for thermally-stabilizing a carbon material precursor of the present invention comprises:

a heating apparatus which thermally-stabilizes a carbon material precursor;

a temperature measuring means for measuring a temperature in the heating apparatus;

a water vapor concentration measuring means for measuring a concentration of water vapor in the heating apparatus; and a temperature control means for feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

In the temperature control means, the temperature range between the temperature range where the generation of water vapor is accelerated in the thermal-stabilization reaction of the carbon material precursor and the temperature range where the generation of water vapor is accelerated in the partial oxidation reaction of the carbon material precursor is preferably set to $T_1$ or more and $T_2$ or less, where a maximum value of the concentration of water vapor generated in the thermal-stabilization reaction of the carbon material precursor is denoted by $C_{max1}$ and a temperature corresponding to the maximum value is denoted by $T_{max1}$, a maximum value of the concentration of water vapor generated in the partial oxidation reaction of the carbon material precursor is denoted by $C_{max2}$ and a temperature corresponding to the maximum value is denoted by $T_{max2}$, a minimum value of the concentration of water vapor generated in a temperature range between $T_{max1}$ and $T_{max2}$ is denoted by $C_{min}$ and a temperature corresponding to the minimum value is denoted by $T_{min}$, a temperature where the concentration of water vapor takes a mean value of $C_{max1}$ and $C_{min}$ $(C_{max1}+C_{min})/2$, in a temperature range between $T_{max1}$ and $T_{min}$ is denoted by $T_1$, and a temperature where the concentration of water vapor takes a mean value of $C_{min}$ and $C_{max2}$ $(C_{min}+C_{max2}/2$, in a temperature range between $T_{min}$ and $T_{max2}$ is denoted by $T_2$.

In addition, the temperature control means is preferably a means for feedback-controlling the temperature in the heating apparatus such that the concentration of water vapor in the heating apparatus is equal to or less than an average value of the concentration of water vapor in the temperature range between $T_1$ or more and $T_2$ or less.

A method for thermally-stabilizing a carbon material precursor of the present invention is a method for thermally-stabilizing a carbon material precursor which uses the thermal-stabilization apparatus of the present invention, and comprises the steps of:

measuring a temperature in the heating apparatus;

measuring a concentration of water vapor in the heating apparatus; and feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

In the step of controlling the temperature, the temperature range between the temperature range where the generation of water vapor is accelerated in the thermal-stabilization reaction of the carbon material precursor and the temperature range where the generation of water vapor is accelerated in the partial oxidation reaction of the carbon material precursor is preferably set to $T_1$ or more and $T_2$ or less, where a maximum value of the concentration of water vapor generated in the thermal-stabilization reaction of the carbon material precursor is denoted by $C_{max1}$ and a temperature corresponding to the maximum value is denoted by $T_{max1}$, a maximum value of the concentration of water vapor generated in the partial oxidation reaction of the carbon material precursor is denoted by $C_{max2}$ and a temperature corresponding to the maximum value is denoted by $T_{max2}$, a minimum value of the concentration of water vapor generated in a temperature range between $T_{max1}$ and $T_{max2}$ is denoted by $C_{min}$ and a temperature corresponding to the minimum value is denoted by $T_{min}$, a temperature where the concentration of water vapor takes a mean value of $C_{max1}$ and $C_{min}$ $(C_{max1}+C_{min})/2$, in a temperature range between $T_{max1}$ and $T_{min}$ is denoted by $T_1$, and a temperature where the concentration of water vapor takes a mean value of $C_{min}$ and $C_{max2}$ $(C_{min}+C_{max2}/2$, in a temperature range between $T_{min}$ and $T_{max2}$ is denoted by $T_2$.

In addition, in the step of controlling the temperature, the temperature in the heating apparatus is preferably feedback-controlled such that the concentration of water vapor in the heating apparatus is equal to or less than the average value of the concentration of water vapor in the temperature range between $T_1$ or more and $T_2$ or less.

Note that although it is not exactly clear why the present invention makes it possible to obtain a thermally-stabilized product (carbon material precursor subjected to thermally-stabilizing treatment) excellent in heat resistance and to produce a carbon material in a high yield, the present inventors presume as follows. In detail, when a carbon material precursor formed of an acrylamide-based polymer is subjected to thermally-stabilizing treatment, for example, the intramolecular dehydration reaction represented by the following formula (1) forms a six-membered ring structure excellent in heat resistance.

(1)

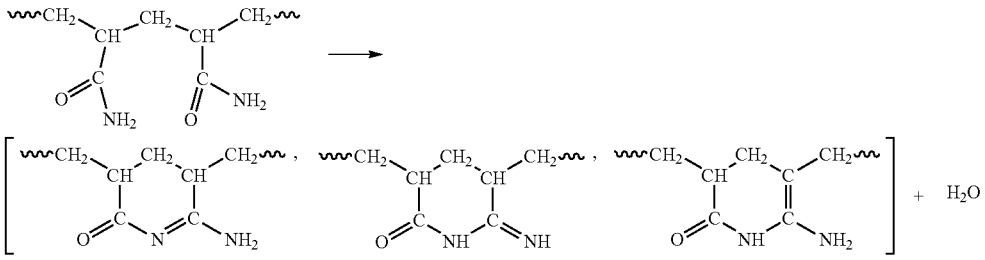

It is presumed that a six-membered ring structure excellent in heat resistance is sufficiently formed because in the present invention, the thermal-stabilization temperature of the carbon material precursor is controlled such that the intramolecular dehydration reaction represented by the formula (1) is completed and the progression of the partial oxidation reaction is suppressed in a temperature range between a temperature range where the generation of water vapor is accelerated in the thermal-stabilization reaction of the carbon material precursor and a temperature range where the generation of water vapor is accelerated in the partial oxidation reaction of the carbon material precursor. In addition, it is presumed that, since the partial oxidation reaction is suppressed in a temperature range which is on the higher temperature side in the temperature range where the thermal-stabilization reaction is accelerated and which is on the lower temperature side in the temperature range where the partial oxidation reaction is accelerated, the produced six-membered ring structure is stably present, making it possible to improve the heat resistance of the thermally-stabilized product and to obtain a carbon material in a high yield.

Besides, it is presumed that, in the temperature range where the generation of water vapor is accelerated in the thermal-stabilization reaction of the carbon material precursor, the intramolecular dehydration reaction represented by the formula (1) is not sufficiently completed and thus a six-membered ring structure excellent in heat resistance is not formed sufficiently, resulting in a situation where the heat resistance of the thermally-stabilized product is lowered and the yield of the carbon material is also lowered.

On the other hand, it is presumed that, in the temperature range where the production of water vapor is accelerated in the partial oxidation reaction of the carbon material precursor, the intramolecular dehydration reaction represented by the formula (1) forms a six-membered ring structure, but the six-membered ring structure produced is thermally decomposed due to the partial oxidation reaction, resulting in a situation where the heat resistance of the thermally-stabilized product is lowered and the yield of the carbon material is also lowered.

The present invention makes it possible to control the thermal-stabilization temperature of the carbon material precursor by using the concentration of water vapor as an index. Also, the present invention makes it possible to obtain a thermally-stabilized product (carbon material precursor subjected to thermally-stabilizing treatment) excellent in heat resistance and to produce a carbon material in a high yield by controlling the thermal-stabilization temperature of the carbon material precursor by using the concentration of water vapor as an index such that the thermal-stabilization temperature of the carbon material precursor is in a temperature range which is on the higher temperature side in the temperature range where the thermal-stabilization reaction of the carbon material precursor is accelerated and which is on the lower temperature side in the temperature range where the partial oxidation reaction is accelerated.

DETAILED DESCRIPTION OF THE PREFERRED EMBODIMENTS

Figure 1:
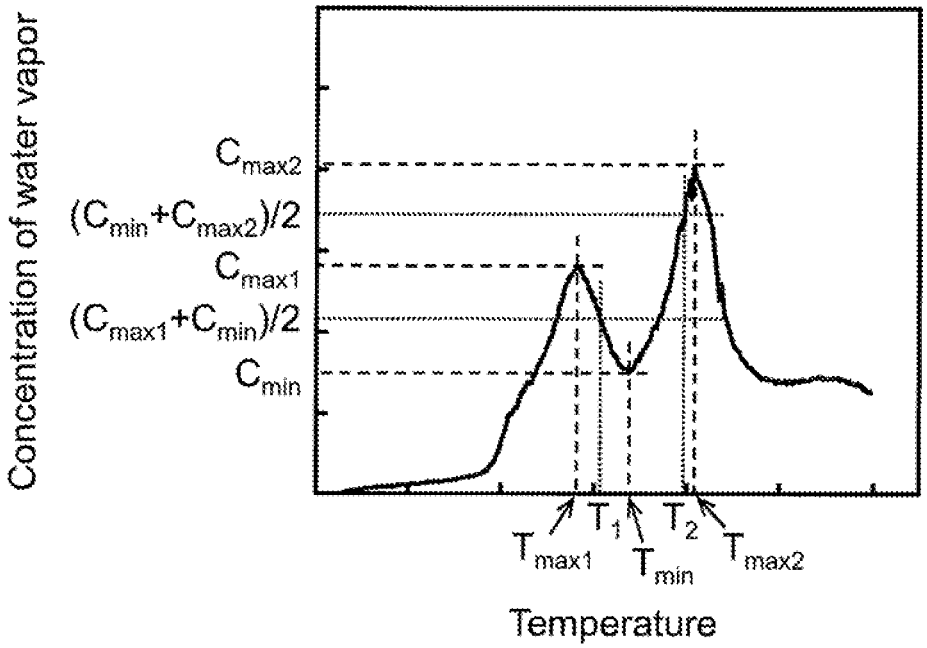
FIG. 1 is a graph illustrating the relationship between the concentration of water vapor generated and the heating temperature at the time of raising the temperature of the carbon material precursor.

Hereinafter, the present invention is described in detail with reference to its preferred embodiments.

An apparatus for thermally-stabilizing a carbon material precursor of the present invention comprises:

a heating apparatus which thermally-stabilizes a carbon material precursor;

a temperature measuring means for measuring a temperature in the heating apparatus;

a water vapor concentration measuring means for measuring a concentration of water vapor in the heating apparatus; and a temperature control means for feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

In addition, a method for thermally-stabilizing a carbon material precursor of the present invention is a method for thermally-stabilizing a carbon material precursor which uses the thermal-stabilization apparatus of the present invention, and comprises the steps of:

measuring a temperature in the heating apparatus;

measuring a concentration of water vapor in the heating apparatus; and feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

[Carbon Material Precursor]

A carbon material precursor used in the present invention is not particularly limited as long as it has a temperature range where the generation of water vapor is accelerated in the thermal-stabilization reaction of the carbon material precursor and a temperature range where the production of water vapor is accelerated in the partial oxidation reaction of the carbon material precursor, and the concentration of water vapor generated has a local minimum value in a temperature range between those temperature ranges. However, the carbon material precursor is preferably one formed of an acrylamide-based polymer.

Such an acrylamide-based polymer may be a homopolymer of an acrylamide-based monomer or a copolymer of an acrylamide-based monomer with another polymerizable monomer, but is preferably a copolymer of an acrylamide-based monomer with another polymerizable monomer from the viewpoint that the yield of the carbon material is improved.

The lower limit of the content of an acrylamide-based monomer unit in the copolymer of an acrylamide-based monomer with another polymerizable monomer is preferably 50 mol % or more, more preferably 60 mol % or more, and particularly preferably 70 mol % or more from the viewpoint of solubility of the copolymer in an aqueous solvent or an aqueous mixture solvent. In addition, the upper limit of the content of an acrylamide-based monomer unit is preferably 99.9 mol % or less, more preferably 99 mol % or less, further preferably 95 mol % or less, particularly preferably 90 mol % or less, and most preferably 85 mol % or less from the viewpoint that the yield of the carbon material is improved.

The lower limit of the content of another polymerizable monomer unit in the copolymer of an acrylamide-based monomer with another polymerizable monomer is preferably 0.1 mol % or more, more preferably 1 mol % or more, further preferably 5 mol % or more, particularly preferably 10 mol % or more, and most preferably 15 mol % or more from the viewpoint that the yield of the carbon material is improved. In addition, the upper limit of the content of another polymerizable monomer unit is preferably 50 mol % or less, more preferably 40 mol % or less, and particularly preferably 30 mol % or less from the viewpoint of solubility of the copolymer in an aqueous solvent or an aqueous mixture solvent.

Examples of the acrylamide-based monomer include acrylamide; N-alkylacrylamides such as N-methylacrylamide, N-ethylacrylamide, N-n-propylacrylamide, N-isopropylacrylamide, N-n-butylacrylamide, and N-tert-butylacrylamide; N-cycloalkyl acrylamides such as N-cyclohexyl acrylamide; dialkylacrylamides such as N,N-dimethylacrylamide; dialkylaminoalkyl acrylamides such as dimethylaminoethyl acrylamide and dimethylaminopropyl acrylamide; hydroxyalkyl acrylamides such as N-(hydroxymethyl) acrylamide and N-(hydroxyethyl)acrylamide; N-arylacrylamides such as N-phenylacrylamide; diacetone acrylamide; N,N'-alkylenebisacrylamides such as N,N'-methylenebisacrylamide; methacrylamide; N-alkylmethacrylamides such as N-methylmethacrylamide, N-ethylmethacrylamide, N-n-propylmethacrylamide, N-isopropylmethacrylamide, N-n-butylmethacrylamide, and N-tert-butylmethacrylamide; N-cycloalkyl methacrylamides such as N-cyclohexyl methacrylamide; dialkyl methacrylamides such as N,N-dimethyl methacrylamide; dialkylaminoalkyl methacrylamides such as dimethylaminoethyl methacrylamide and dimethylaminopropyl methacrylamide; hydroxyalkyl methacrylamides such as N-(hydroxymethyl) methacrylamide and N-(hydroxyethyl)methacrylamide; N-arylmethacrylamides such as N-phenylmethacrylamide; diacetone methacrylamide; and N,N'-alkylenebismethacrylamides such as N,N'-methylenebismethacrylamide. These acrylamide-based monomers may be used singly or two or more kinds thereof may be used in combination. In addition, among these acrylamide-based monomers, acrylamide, N-alkylacrylamides, dialkylacrylamides, methacrylamide, N-alkylmethacrylamides, and dialkyl methacrylamides are preferable and acrylamide is particularly preferable from the viewpoint of high solubility in an aqueous solvent or an aqueous mixture solvent.

Examples of the other polymerizable monomer include vinyl cyanide-based monomers, unsaturated carboxylic acids and salts thereof, unsaturated carboxylic acid anhydrides, unsaturated carboxylic acid esters, vinyl-based monomers, and olefin-based monomers. Examples of the vinyl cyanide-based monomer include acrylonitrile, methacrylonitrile, 2-hydroxyethylacrylonitrile, chloroacrylonitrile, chloromethacrylonitrile, methoxyacrylonitrile, and methoxymethacrylonitrile. Examples of the unsaturated carboxylic acid include acrylic acid, methacrylic acid, and itaconic acid, examples of the unsaturated carboxylic acid anhydride include maleic anhydride and itaconic anhydride, examples of the unsaturated carboxylic acid ester include methyl acrylate, methyl methacrylate, 2-hydroxyethyl acrylate, and 2-hydroxyethyl methacrylate, examples of the vinyl-based monomer include styrene, α-methylstyrene, vinyl chloride, and vinyl alcohol, and examples of the olefin-based monomer include ethylene and propylene. These other polymerizable monomers may be used singly or two or more kinds thereof may be used in combination. In addition, among these other polymerizable monomers, vinyl cyanide-based monomers are preferable and acrylonitrile is particularly preferable from the viewpoint that the forming processability (spinning property) of the carbon material precursor is improved and the yield of the carbon material is improved, and unsaturated carboxylic acids and salts thereof are preferable from the viewpoint of solubility of the copolymer in an aqueous solvent or an aqueous mixture solvent.

[Heating Apparatus]

The heating apparatus used in the present invention is not particularly limited as long as it can thermally-stabilize the carbon material precursor, and examples thereof include electric furnaces, gas furnaces, microwave furnaces, and infrared furnaces. In addition, such a heating apparatus is preferably of continuous type. This makes it possible to continuously supply the carbon material precursor for continuous thermally-stabilizing treatment, which enables continuous production of the carbon material as well as productivity improvement. Moreover, since it is necessary to thermally-stabilize the carbon material precursor in an oxidizing gas atmosphere, the heating apparatus is connected with an oxidizing gas supplying means for supplying an oxidizing gas (for example, a mixture gas of oxygen gas and inert gas).

[Temperature Measuring Means and Temperature Measuring Step]

The temperature measuring means used in the present invention is not particularly limited as long as it can measure the temperature in the heating apparatus, and examples thereof include thermocouple thermometers, radiation thermometers, and resistance thermometers. In addition, the temperature measuring step according to the present invention is not particularly limited as long as it is a step of measuring the temperature in the heating apparatus using such a temperature measuring means according to the present invention.

[Water Vapor Concentration Measuring Means and Water Vapor Concentration Measuring Step]

The water vapor concentration measuring means used in the present invention is not particularly limited as long as it can measure the concentration of water vapor in the heating apparatus, and examples thereof include water vapor concentration meters, gas chromatographs, and mass spectrometers. In addition, the water vapor concentration measuring step according to the present invention is not particularly limited as long as it is a step of measuring the temperature in the heating apparatus using such a water vapor concentration measuring means according to the present invention, and examples thereof include a step of directly measuring the concentration of water vapor in the heating apparatus using the water vapor concentration measuring means and a step including collecting the gas in the heating apparatus and then measuring the concentration of water vapor in the collected gas by using the water vapor concentration measuring means.

[Temperature Control Means and Temperature Control Step]

The temperature control means and the temperature control step according to the present invention are the below-described control means and control step which use a method for controlling the temperature in the heating apparatus.

The method for controlling the temperature in the heating apparatus used in the present invention is a method for feedback-controlling the temperature in the heating apparatus by using the concentration of water vapor as an index such that a thermal-stabilization reaction of the carbon material precursor and generation of water vapor therein are completed and a partial oxidation reaction of the carbon material precursor and generation of water vapor therein are suppressed in a temperature range between a temperature range where the generation of water vapor is accelerated in the thermal-stabilization reaction and a temperature range where the generation of water vapor is accelerated in the partial oxidation reaction. As described above, it is possible to improve the heat resistance of the thermally-stabilized product and to obtain a carbon material in a high yield by feedback-controlling the temperature in the heating apparatus by using the concentration of water vapor as an index such that the thermal-stabilization reaction and the generation of water vapor therein are completed and the partial oxidation reaction and the generation of water vapor therein are suppressed. Particularly in the case where the carbon material precursor is formed of the acrylamide-based polymer, a six-membered ring structure excellent in heat resistance is easily produced and stably present, making it possible to improve the heat resistance of the thermally-stabilized product and to obtain a carbon material in a high yield.

In addition, in such a method for controlling the temperature in the heating apparatus, it is preferable to set as below the temperature range between the temperature range where the generation of water vapor is accelerated in the thermal-stabilization reaction of the carbon material precursor and the temperature range where the generation of water vapor is accelerated in the partial oxidation reaction of the carbon material precursor. FIG. 1 illustrates the relationship between the concentration of water vapor generated and the heating temperature in the thermal-stabilization reaction of the carbon material precursor. As illustrated in FIG. 1, a maximum value of the concentration of water vapor generated in the thermal-stabilization reaction of the carbon material precursor is denoted by $C_{max1}$ and a temperature corresponding to the maximum value is denoted by $T_{max1}$. In addition, a maximum value of the concentration of water vapor generated in the partial oxidation reaction of the carbon material precursor is denoted by $C_{max2}$ and a temperature corresponding to the maximum value is denoted by $T_{max2}$. Furthermore, a minimum value of the concentration of water vapor generated in a temperature range between $T_{max1}$ and $T_{max2}$ is denoted by $C_{min}$ and a temperature corresponding to the minimum value is denoted by $T_{min}$. When a temperature where the concentration of water vapor takes a mean value of $C_{max1}$ and $C_{min}$, $(C_{max1}+C_{min})/2$, in a temperature range between $T_{max1}$ and $T_{min}$ is denoted by $T_1$ and a temperature where the concentration of water vapor takes a mean value of $C_{min}$ and $C_{max2}$ $(C_{min}+C_{max2})/2$, in a temperature range between $T_{min}$ and $T_{max2}$ is denoted by $T_2$, the temperature range between the temperature range where the generation of water vapor is accelerated in the thermal-stabilization reaction of the carbon material precursor and the temperature range where the generation of water vapor is accelerated in the partial oxidation reaction of the carbon material precursor is preferably set to $T_1$ or more and $T_2$ or less. When the heating temperature in the thermal-stabilization reaction of the carbon material precursor is less than $T_1$, there is a tendency that the heat resistance of the thermally-stabilized product is lowered and the yield of the carbon material is also lowered. Particularly in the case where the carbon material precursor is formed of the acrylamide-based polymer, the intramolecular dehydration reaction represented by the formula (1) is not sufficiently completed and thus a six-membered ring structure excellent in heat resistance is not formed sufficiently. Therefore, there is a tendency that the heat resistance of the thermally-stabilized product is lowered and the yield of the carbon material is also lowered. On the other hand, when the heating temperature in the thermal-stabilization reaction of the carbon material precursor exceeds $T_2$, there is a tendency that the heat resistance of the thermally-stabilized product is lowered and the yield of the carbon material is also lowered. Particularly in the case where the carbon material precursor is formed of the acrylamide-based polymer, the intramolecular dehydration reaction represented by the formula (1) produces a six-membered ring structure, but the six-membered ring structure produced is thermally decomposed due to the partial oxidation reaction. Therefore, there is a tendency that the heat resistance of the thermally-stabilized product is lowered and the yield of the carbon material is also lowered.

Moreover, in the method for controlling the temperature in the heating apparatus according to the present invention, the temperature in the heating apparatus is preferably feedback-controlled such that the concentration of water vapor in the heating apparatus is equal to or less than an average value of the concentration of water vapor in the temperature range between $T_1$ or more and $T_2$ or less. When the concentration of water vapor in the heating apparatus exceeds the average value of the concentration of water vapor in the temperature range between $T_1$ or more and $T_2$ or less, the thermal-stabilization reaction is not sufficiently completed. Therefore, there is a tendency that the heat resistance of the thermally-stabilized product is lowered and the yield of the carbon material is also lowered. Particularly in the case where the carbon material precursor is formed of the acrylamide-based polymer, the six-membered ring structure produced by the intramolecular dehydration reaction represented by the formula (1) is thermally decomposed due to the partial oxidation reaction. Therefore, there is a tendency that the heat resistance of the thermally-stabilized product is lowered and the yield of the carbon material is also lowered.

Figure 2:
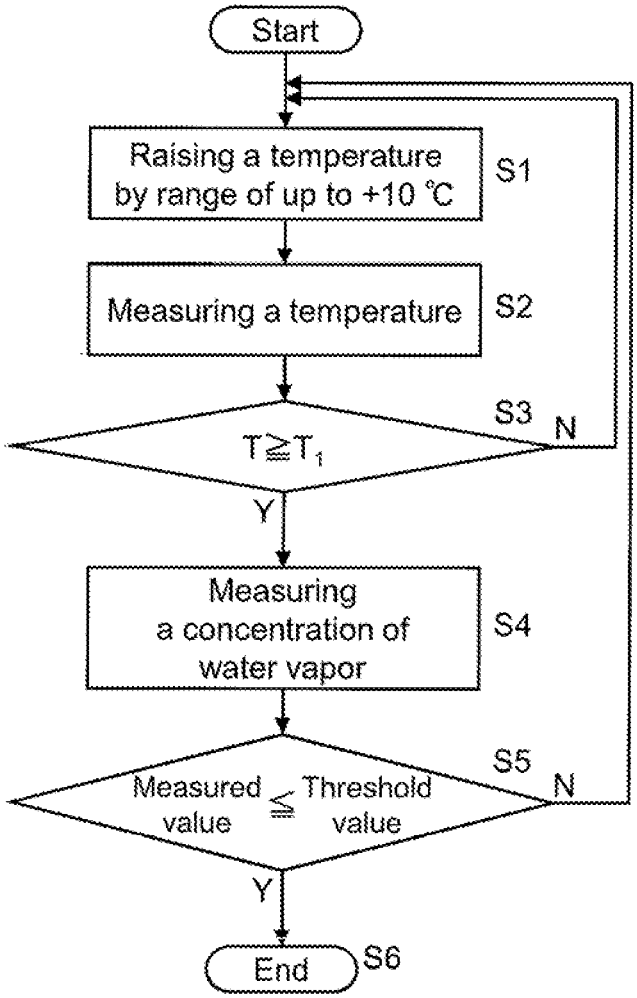
FIG. 2 is a flowchart illustrating the procedure of temperature control in the temperature control means and the temperature control step according to the present invention.

Next, such a method for controlling the temperature in the heating apparatus is described along with the temperature control procedure illustrated in FIG. 2. First, the temperature in the heating apparatus is raised by a range of up to +10° C. (step S1), and the temperature T in the heating apparatus is measured by using the temperature measuring means (step S2). The temperature in the heating apparatus is controlled based on this temperature T (step S3). Specifically, when the temperature T in the heating apparatus is less than $T_1$ ($T<T_1$), the temperature in the heating apparatus is further raised by a range of up to +10° C. (step S1) to control the temperature T in the heating apparatus such that $T \geq T_1$.

Next, the concentration of water vapor in the heating apparatus is measured by using the water vapor concentration measuring means (step S4), and the temperature in the heating apparatus is controlled based on the measured value of this water vapor concentration (step S5). Specifically, when the measured value of the water vapor concentration is equal to or less than the threshold value (average value of the concentration of water vapor in the temperature range between $T_1$ or more and $T_2$ or less), the temperature in the heating apparatus is kept to continue the thermally-stabilizing treatment (step S6), and when the measured value exceeds the threshold value, the temperature in the heating apparatus is further raised by a range of up to +10° C. (step S1). This temperature rise is repeated until the measured value of the concentration of water vapor is equal to or less than the threshold value of the concentration of water vapor.

Figure 3:
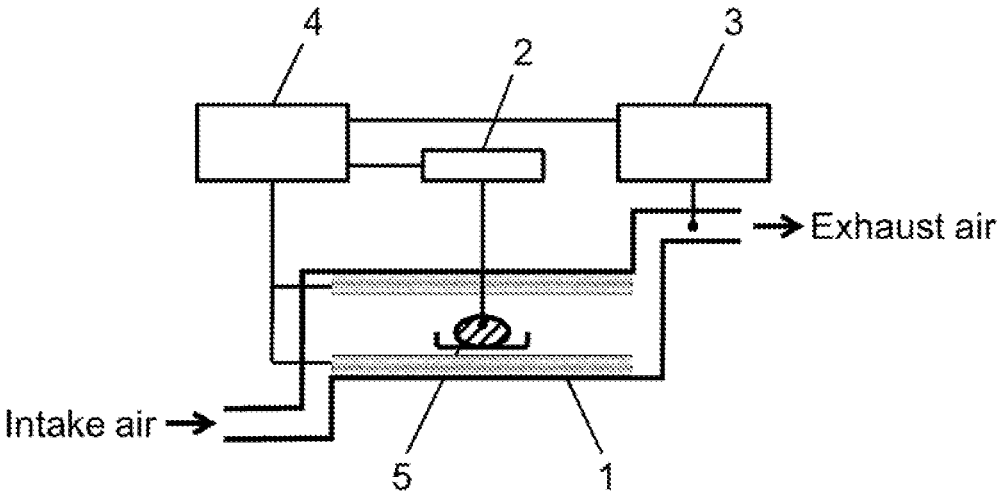
FIG. 3 is a schematic diagram illustrating a preferable embodiment of the apparatus for thermally-stabilizing a carbon material precursor of the present invention.

Such an apparatus for thermally-stabilizing the carbon material precursor of the present invention provided with the heating apparatus, the temperature measuring means, the water vapor concentration measuring means, and the temperature control means is, for example, a batch type thermal-stabilization apparatus illustrated in FIG. 3. In FIG. 3, reference numeral 1 indicates a batch type heating apparatus, reference numeral 2 indicates a temperature measuring means, reference numeral 3 indicates a water vapor concentration measuring means, reference numeral 4 indicates a temperature control means, and reference numeral 5 indicates a carbon material precursor.

A thermally-stabilized product obtained by such a thermal-stabilization method of the present invention is excellent in heat resistance. In such a thermally-stabilized product, the molar ratio of oxygen to carbon (oxygen/carbon) is preferably 0.15 or less, and the ratio of the infrared absorption intensity resulting from the in-plane vibration of the six-membered ring structure in the carbon material precursor after thermally-stabilizing treatment (thermally-stabilized product) (wave number: 1180 to 1240 $cm^{-1}$) to the infrared absorption intensity resulting from the in-plane vibration of the six-membered ring structure in the carbon material precursor before thermally-stabilizing treatment (wave number: 1180 to 1240 $cm^{-1}$) [I (after thermally-stabilizing treatment)/I (before thermally-stabilizing treatment)] is preferably 1.7 or more.

In addition, it is possible to obtain a carbon material in a high yield by carbonizing a thermally-stabilized product obtained by such a thermal-stabilization method of the present invention under an inert gas atmosphere. When the carbonizing treatment is carried out at a temperature of particularly 1100° C. or more, it is possible to obtain a carbon material having a carbon content of 90% by mass or more and further to obtain a carbon material for which the peak intensity ratio between the G-band originating from a graphite structure (wave number: near 1590 $cm^{-1}$) and the D-band originating from a defective structure (wave number: near 1350 $cm^{-1}$) in a Raman spectrum [I(G)/I(D)] is 1.0 or more.

EXAMPLES

Hereinafter, the present invention is described more specifically based on an example and a comparative example, but the present invention is not limited to the following example. Note that the method for synthesizing the acrylamide-based polymer used in the example and the comparative example is shown below.

Synthesis Example 1

To 480 ml of ion exchanged water, 96.0 g (1.35 mol) of acrylamide (AAm, manufactured by Wako Pure Chemical Industries, Ltd.) and 23.9 g (0.45 mol) of acrylonitrile (AN) were dissolved, and the resultant aqueous solution was added with 6.75 ml (0.045 mol) of tetramethylethylenediamine, followed by stirring under a nitrogen atmosphere to raise the temperature to 40° C. Next, 4.11 g (0.018 mol) of ammonium persulfate was added thereto, followed by performing a polymerization reaction at 60° C. for 3 hours. The resultant aqueous solution was poured into methanol to precipitate the copolymer, which was collected and vacuum-dried to obtain a solid acrylamide/acrylonitrile copolymer (AAm/AN copolymer).

This AAm/AN copolymer was dissolved in heavy water, and the resultant aqueous solution was subjected to $^{13}C$-NMR measurement under the conditions of room temperature and a frequency of 100 MHz. In the obtained $^{13}C$-NMR spectrum, the ratio between acrylamide (AAm) units and acrylonitrile (AN) units in the AAm/AN copolymer was calculated based on the intensity ratio between the peak originating from the carbons of the cyano groups of acrylonitrile appearing at about 121 ppm to about 122 ppm and the peak originating from the carbons of the carbonyl groups of acrylamide appearing at about 177 ppm to about 182 ppm, and the result was AAm/AN=75 mol %/25 mol %.

In addition, the weight average molecular weight Mw and the number average molecular weight Mn of the obtained AAm/AN copolymer were measured by using a gel permeation chromatography ("HLC-8220 GPC" manufactured by Tosoh Corporation) in the following conditions. The results were such that Mw was 62000, Mn was 24000, and polydispersity (Mw/Mn) was 2.6.

[Measurement Conditions]

Column: TSKgel $GMPW_{XL}$×2+TSKgel $G2500PW_{XL}$×1.

Eluent: 100 mM sodium nitrate aqueous solution/acetonitrile=80/20.

Eluent flow rate: 1.0 ml/min.

Column temperature: 40° C.

Molecular weight standard: Polyethylene oxide standard/Polyethylene glycol standard.

Detector: Differential refractometer.

The solid AAm/AN copolymer thus obtained was pulverized and sized so as to have a diameter of about 1 mm or less, followed by drying in the atmosphere at 120° C. for 12 hours.

<Thermogravimetry-Mass Spectrometry>

An alumina pan was filled with the dried AAm/AN copolymer powder (about 2 g) obtained in Synthesis Example 1, which was placed on the sample stage of a thermogravimetry-mass spectrometry simultaneous measurement apparatus ("TG-DTA2020SA/MS9610" manufactured by Bruker AXS). Under the flow of a mixture gas of oxygen (20 vol %) and helium (80 vol %) (gas flow rate: 200 ml/min), the AAm/AN copolymer powder was heated from room temperature to 600° C. at a rate of temperature rise of 10° C./min to carry out thermogravimetric analysis. Note that an empty alumina pan was placed on the reference sample stage. In addition, simultaneously with the thermogravimetric analysis, mass spectrometry of the generated gas was carried out in a scanning range of m/z=2 to 60 using a quadrupole mass spectrometer.

Figure 4:
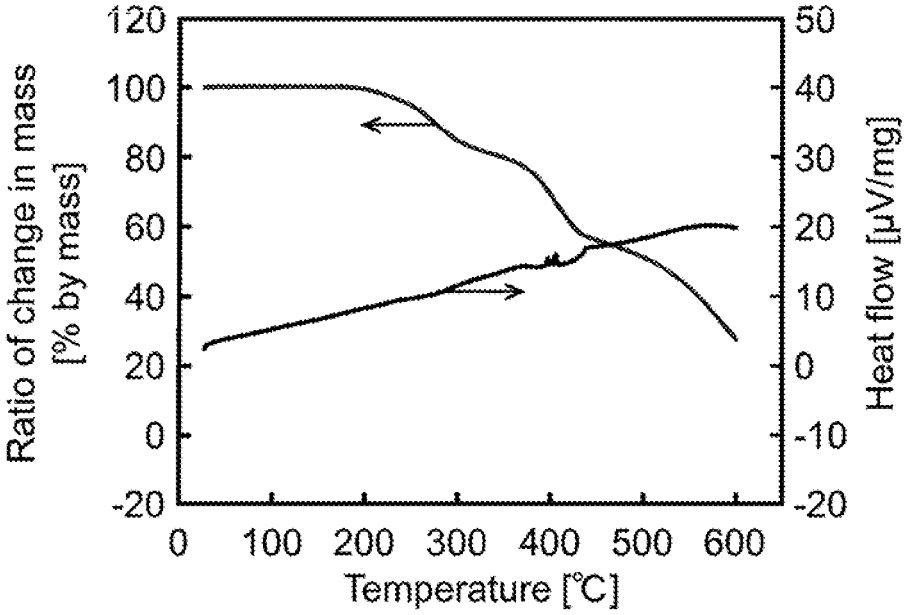
FIG. 4 is a graph illustrating the results of thermogravimetric analysis for the acrylamide-based polymer obtained in Synthesis Example 1.

Based on the results of thermogravimetric analysis, the ratio of change in the mass of the AAm/AN copolymer at various measurement temperatures during temperature rise was calculated with reference to the mass at 100° C. using the following formula. FIG. 4 illustrates the results. Ratio of change in mass (% by Mass)=$M_T/M_{100}$×100 [$M_T$: mass of the AAm/AN copolymer at measurement temperature T (° C.), and $M_{100}$: mass of the AAm/AN copolymer at 100° C.]

Figure 5:
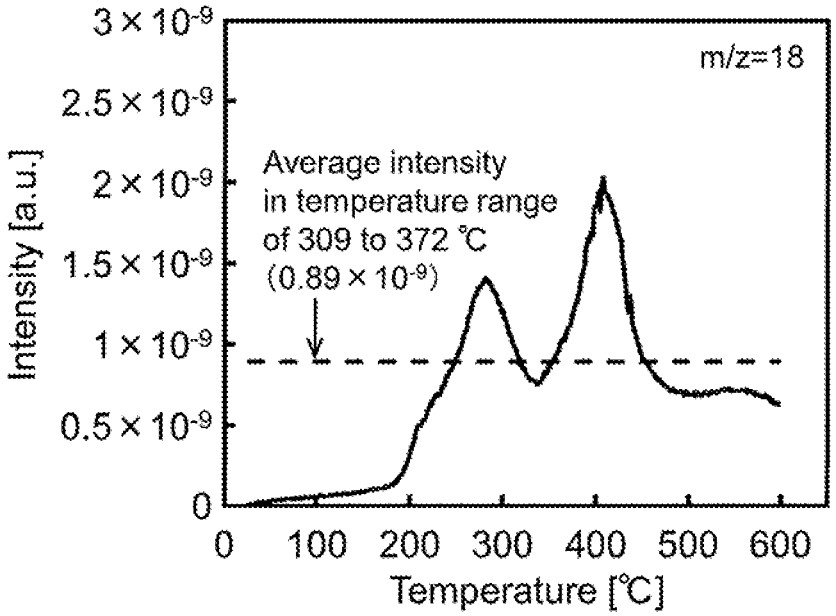
FIG. 5 is a graph illustrating the relationship between the intensity at m/z=18 and the heating temperature at the time of raising the temperature of the acrylamide-based polymer obtained in Synthesis Example 1.

Additionally, based on the results of mass spectrometry, the intensity at m/z=18 (mass number of $H_2O$) at various measurement temperatures during temperature rise was calculated as the measured value corresponding to the concentration of water vapor generated by heating the AAm/AN copolymer. FIG. 5 illustrates the results.

As illustrated in FIG. 4, the decrease in the mass of the AAm/AN copolymer was accelerated in three temperature ranges of about 200° C. to about 310° C., about 370° C. to about 430° C., and about 500° C. or more. These are conceivably due to the thermal-stabilization reaction, the partial oxidation reaction, and the complete oxidation reaction, respectively.

Additionally, as illustrated in FIG. 5, the concentration of water vapor increased in the temperature range of about 200° C. to about 310° C. and reached its maximum at $T_{max1}$=281° C. This is conceivably because the generation of water vapor was accelerated in the thermal-stabilization reaction. In addition, the concentration of water vapor increased also in the temperature range of about 370° C. to about 430° C. and reached its maximum at $T_{max2}$=407° C. This is conceivably because the generation of water vapor was accelerated in the partial oxidation reaction. Furthermore, the generation of water vapor was suppressed in the temperature range between $T_{max1}$=281° C. and $T_{max2}$=407° C., suggesting the presence of the temperature $T_{min}$=337° C. where the concentration of water vapor took the minimum.

Example 1

[Setting Threshold Value for Concentration of Water Vapor]

First, a threshold value for the concentration of water vapor was set based on the results of mass spectrometry illustrated in FIG. 5 (m/z=18). Specifically, in the temperature range between the temperature $T_{max1}$=281° C. where the concentration of water vapor generated in the thermal-stabilization reaction of the carbon material precursor reaches its maximum ($C_{max1}$) and the temperature $T_{min}$=337° C. where the concentration of water vapor reaches its minimum ($C_{min}$), the temperature $T_1$, where the concentration of water vapor is the mean value of $C_{max1}$ and $C_{min}$, $(C_{max1}+C_{min})/2$, was calculated to be $T_1$=309° C. In addition, in the temperature range between the temperature $T_{min}$=337° C. where the concentration of water vapor reaches its minimum ($C_{min}$) and the temperature $T_{max2}$=407° C. where the concentration of water vapor generated in the partial oxidation reaction of the carbon material precursor reaches its maximum ($C_{max2}$) the temperature $T_2$, where the concentration of water vapor is the mean value of $C_{min}$ and $C_{max2}$ $(C_{min}+C_{max2})/2$, was calculated to be $T_2$=372° C. The average value of the concentration of water vapor in the temperature range between $T_1$=309° C. or more and $T_2$=372° C. or less was calculated, and the average value for the intensity in the results of mass spectrometry illustrated in FIG. 5 (m/z=18) was $0.89\times10^{-9}$. This was used as the threshold value for the concentration of water vapor (threshold value for the intensity at m/z=18) to carry out the following thermally-stabilizing treatment.

[Thermally-Stabilizing Treatment]

A quartz boat (capacity of 2 ml) was filled with the dried AAm/AN copolymer powder (about 0.3 g) obtained in Synthesis Example 1 as a carbon material precursor, which was placed in a quartz tube (inner diameter of 16 mm) introduced in an electric tube furnace. While allowing the air to flow through the quartz tube (gas flow rate: 1000 ml/min), the temperature in the electric tube furnace was controlled as follows in accordance with the temperature control procedure illustrated in FIG. 2 at a rate of temperature rise of 10° C./min. In this way, the carbon material precursor formed of the AAm/AN copolymer was thermally-stabilized.

Specifically, first, the temperature in the electric tube furnace was raised by a range of up to +10° C. (step S1), and the temperature T in the electric tube furnace was measured (step S2). The temperature in the electric tube furnace was controlled based on this temperature T (step S3). To be more precise, when the temperature T in the electric tube furnace was less than $T_1$=309° C., the temperature in the electric tube furnace was further raised by a range of up to +10° C. (step S1) to control the temperature T in the electric tube furnace at $T_1$=309° C. or more. This temperature rise was repeated until the temperature T in the electric tube furnace was $T_1$=309° C. or more.

Next, the concentration of water vapor in the electric tube furnace was measured (step S4), and the temperature in the electric tube furnace was controlled based on the measured value of this water vapor concentration (step S5). Specifically, when the measured value of the water vapor concentration was equal to or less than the threshold value, the temperature in the electric tube furnace was kept to continue the thermally-stabilizing treatment (step S6), and when the measured value exceeded the threshold value, the temperature in the electric tube furnace was further raised by a range of up to +10° C. (step S1). This temperature rise was repeated until the measured value of the concentration of water vapor was equal to or less than the threshold value. Specifically, the gas in the electric tube furnace was collected to determine the intensity at m/z=18 by mass spectrometry (step S4). When the measured value for this intensity at m/z=18 was equal to or less than the threshold value at m/z=18 ($0.89\times10^{-9}$), the temperature in the electric tube furnace was kept to continue the thermally-stabilizing treatment (step S6), and when the measured value exceeded the threshold value at m/z=18 ($0.89\times10^{-9}$), the temperature in the electric tube furnace was further raised by a range of up to +10° C. (step S1).

In addition, the temperature in the electric tube furnace during the thermally-stabilizing treatment was measured and found to be controlled at a temperature of around 350° C. This proved that, when the concentration of water vapor is used as an index as described above, it is possible to feedback-control the temperature in the heating apparatus such that the generation of water vapor in the thermal-stabilization reaction is completed and the generation of water vapor in the partial oxidation reaction is suppressed.

<Thermal-Stabilization Yield, Carbonization Yield, and Total Yield of Thermal-Stabilization and Carbonization>

An alumina pan was filled with the dried AAm/AN copolymer powder (about 2 g) obtained in Synthesis Example 1 as a carbon material precursor, which was placed on the sample stage of an infrared heating type differential thermal balance ("Thermo plus TG8120" manufactured by Rigaku Corporation). Under the flow of the air (gas flow rate: 500 ml/min), the carbon material precursor was heated from room temperature to a predetermined temperature (300° C., 350° C., 400° C., 450° C.) at a rate of temperature rise of 10° C./min, followed by keeping the heating temperature at the predetermined temperature for 30 minutes to carry out thermally-stabilizing treatment. Note that an empty alumina pan was placed on the reference sample stage. The thermal-stabilization yield of the carbon material precursor was calculated by using the mass of the carbon material precursor after thermally-stabilizing treatment at each of the thermal-stabilization temperatures and the mass of the carbon material precursor at 100° C. by the following formula:

$$\text{Thermal-stabilization yield (\%)}=M_T/M_{100}\times100$$

[$M_T$: mass of the carbon material precursor at the thermal-stabilization temperature T (° C.), and $M_{100}$: mass of the carbon material precursor at 100° C.].

Table 1 shows the results.

Next, the temperature of the carbon material precursor after the thermally-stabilizing treatment (thermally-stabilized product) was reduced to room temperature, and then the thermally-stabilized product was heated from room temperature to 1300° C. at a rate of temperature rise of 20° C./min under the flow of a nitrogen gas (gas flow rate: 500 ml/min) to carry out carbonizing treatment. The carbonization yield of the thermally-stabilized product was calculated by using the mass of the thermally-stabilized product at 1100° C. during temperature rise and the mass of the thermally-stabilized product at 100° C. by the following formula:

$$\text{Carbonization yield (\%)}=M_{1100}/M_{100}\times100$$

[$M_{100}$: mass of the thermally-stabilized product at 1100° C., and $M_{100}$: mass of the thermally-stabilized product at 100° C.].

Table 1 shows the results.

Additionally, by the following formula:

$$\text{Total yield}=(\text{Thermal-stabilization yield}/100)\times(\text{Carbonization yield}/100)\times100$$

the total yield of thermal-stabilization and carbonization (yield of the carbon material) was calculated. Table 1 shows the results. Note that Table 1 also shows the carbonization yield and the total yield of thermal-stabilization and carbonization in the case of directly carbonizing the carbon material precursor without thermally-stabilizing treatment.

TABLE 1

| Thermal-stabilization temperature [° C.] | Thermal-stabilization yield [%] | Carbonization yield [%] | Total yield [%] |
|---|---|---|---|
| — | 100 | 19 | 19 |
| 300 | 79 | 30 | 23 |
| 350 | 66 | 48 | 32 |
| 400 | 52 | 50 | 26 |
| 450 | 40 | 46 | 18 |

As shown in Table 1, the yield of the carbon material was found to be highest at a thermal-stabilization temperature of around 350° C. Therefore, it was found that, in the thermally-stabilizing treatment of the carbon material precursor, it is possible to obtain a carbon material in a high yield by feedback-controlling the temperature in the electric tube furnace by using the concentration of water vapor as an index such that the generation of water vapor in the thermal-stabilization reaction of the carbon material precursor is completed and the generation of water vapor in the partial oxidation reaction is suppressed.

<Elemental Analysis of Thermally-Stabilized Product>

A quartz boat (capacity of 2 ml) was filled with the dried AAm/AN copolymer powder (about 0.3 g) obtained in Synthesis Example 1 as a carbon material precursor, which was placed in a quartz tube (inner diameter of 16 mm) introduced in an electric tube furnace. While allowing the air to flow through the quartz tube (gas flow rate: 1000 ml/min), the carbon material precursor was heated from room temperature to a predetermined temperature (300° C., 350° C., 400° C., 450° C.) at a rate of temperature rise of 10° C./min, followed by keeping the heating temperature at the predetermined temperature for 30 minutes to carry out thermally-stabilizing treatment.

An elemental analysis of the obtained thermally-stabilized product was carried out in the following manner to determine the content of each element and the molar ratio of oxygen/carbon. Table 2 shows the results. Note that Table 2 also shows the content of each element and the molar ratio of oxygen/carbon in the carbon material precursor in the case without thermally-stabilizing treatment.

(Carbon Analysis)

By using an elemental analyzer ("NCH-22F" manufactured by Sumika Chemical Analysis Service, Ltd.), the thermally-stabilized product was heated in an oxygen stream to convert carbon into $CO_2$, and the produced $CO_2$ was quantified by a gas chromatograph equipped with a thermal conductivity detector to calculate the carbon content in the thermally-stabilized product.

(Hydrogen Analysis)

By using an elemental analyzer ("NCH-22F" manufactured by Sumika Chemical Analysis Service, Ltd.), the thermally-stabilized product was heated in an oxygen stream to convert hydrogen into $H_2O$, and the produced $H_2O$ was quantified by a gas chromatograph equipped with a thermal conductivity detector to calculate the hydrogen content in the thermally-stabilized product.

(Nitrogen Analysis)

By using an elemental analyzer ("NCH-22F" manufactured by Sumika Chemical Analysis Service, Ltd.), the thermally-stabilized product was heated in an oxygen stream to convert nitrogen into $N_2$, and the produced $N_2$ was quantified by a gas chromatograph equipped with a thermal conductivity detector to calculate the nitrogen content in the thermally-stabilized product.

(Oxygen Analysis)

By using an elemental analyzer ("EMGA-920" manufactured by Horiba, Ltd.), the thermally-stabilized product was heated in a graphite crucible in a helium stream to convert oxygen into CO, and the produced CO was quantified by a non-dispersive infrared detector to calculate the oxygen content in the thermally-stabilized product.

TABLE 2

| Thermal-stabilization temperature | Content of element [%] | | | | Molar ratio of |
|---|---|---|---|---|---|
| [° C.] | Carbon | Hydrogen | Nitrogen | Oxygen | oxygen/carbon |
| — | 52.1 | 6.8 | 19.8 | 20.3 | 0.29 |
| 300 | 62.2 | 4.7 | 16.7 | 16.7 | 0.20 |
| 350 | 66.5 | 3.7 | 17.1 | 12.0 | 0.14 |
| 400 | 65.1 | 2.6 | 17.9 | 13.5 | 0.16 |
| 450 | 61.6 | 1.9 | 20.2 | 14.5 | 0.18 |

As shown in Table 2, the oxygen content and the molar ratio of oxygen/carbon in the thermally-stabilized product were found to be lowest at a thermal-stabilization temperature of around 350° C. Therefore, it was found that, in the thermally-stabilizing treatment of the carbon material precursor, it is possible to obtain a thermally-stabilized product with a small oxygen content and molar ratio of oxygen/carbon by feedback-controlling the temperature in the electric tube furnace by using the concentration of water vapor as an index such that the generation of water vapor in the thermal-stabilization reaction of the carbon material precursor is completed and the generation of water vapor in the partial oxidation reaction is suppressed.

Additionally, in the range of thermal-stabilization temperatures of 300 to 350° C., as the thermal-stabilization temperature increased, the oxygen content and the molar ratio of oxygen/carbon in the thermally-stabilized product were lowered conceivably because the thermal-stabilization reaction was accelerated to facilitate the formation of a six-membered ring structure due to dehydration condensation between adjacent amide groups and to facilitate the emission of oxygen in the carbon material precursor in the form of water vapor. Meanwhile, in the range of thermal-stabilization temperatures of 350 to 450° C., as the thermal-stabilization temperature increased, the oxygen content and the molar ratio of oxygen/carbon in the thermally-stabilized product were increased conceivably because the partial oxidation reaction was accelerated to facilitate the intake of oxygen into the thermally-stabilized product.

<Elemental Analysis of Carbon Material>

A quartz boat (capacity of 2 ml) was filled with the dried AAm/AN copolymer powder (about 0.3 g) obtained in Synthesis Example 1 as a carbon material precursor, which was placed in a quartz tube (inner diameter of 16 mm) introduced in an electric tube furnace. While allowing the air to flow through the quartz tube (gas flow rate: 1000 ml/min), the carbon material precursor was heated from room temperature to 350° C. at a rate of temperature rise of 10°

C./min, followed by keeping the heating temperature at 350° C. for 30 minutes to carry out thermally-stabilizing treatment.

Next, the temperature of the carbon material precursor after the thermally-stabilizing treatment (thermally-stabilized product) was reduced to room temperature. Then, while allowing a nitrogen gas to flow through the quartz tube (gas flow rate: 1000 ml/min), the thermally-stabilized product was heated from room temperature to a predetermined temperature (800° C., 900° C., 1000° C., 1100° C.) at a rate of temperature rise of 20° C./min, followed by keeping the heating temperature at the predetermined temperature for 10 minutes to carry out carbonizing treatment.

An elemental analysis of the obtained carbon material was carried out in accordance with the method described in <Elemental Analysis of Thermally-Stabilized Product> to determine the content of each element. Table 3 shows the results.

TABLE 3

| Carbonization temperature | Content of element [%] | | | |
|---|---|---|---|---|
| [° C.] | Carbon | Hydrogen | Nitrogen | Oxygen |
| 800 | 79.5 | 0.9 | 14.7 | 3.6 |
| 900 | 81.8 | 0.5 | 12.9 | 3.2 |
| 1000 | 86.1 | 0.3 | 8.9 | 2.4 |
| 1100 | 90.3 | 0.1 | 6.8 | 1.3 |

As shown in Table 3, in the range of carbonization temperature of 800 to 1100° C., the carbon content in the carbon material was found to increase with the increase of carbonization temperature. This is conceivably because the increase in carbonization temperature facilitates the formation of a structure similar to that of graphite.

<Infrared Spectroscopy>

Figure 6:
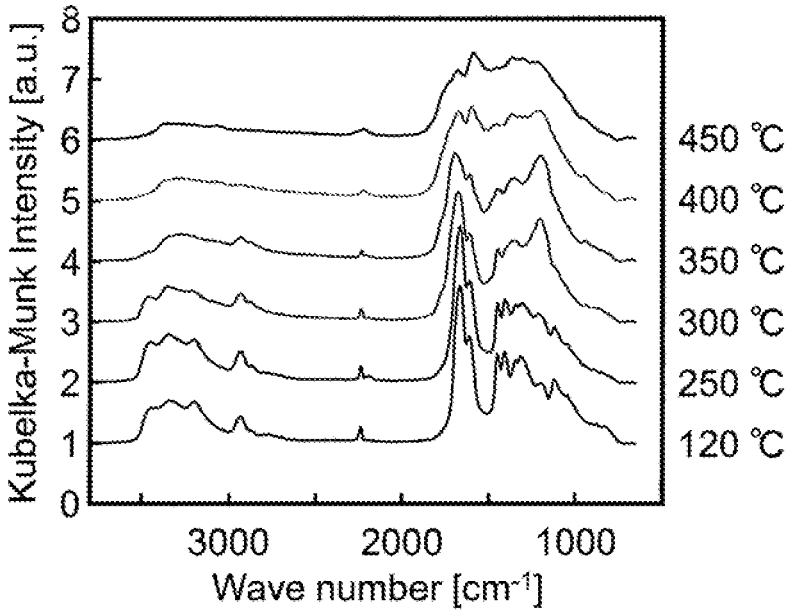
FIG. 6 is a graph illustrating FT-IR absorption spectra of a carbon material precursor formed of an acrylamide-based polymer obtained in Synthesis Example 1 after thermally-stabilizing treatment at various temperatures.

The dried AAm/AN copolymer powder (about 4 mg) obtained in Synthesis Example 1 as a carbon material precursor and calcium fluoride (about 76 mg) as a diluent were physically mixed in a mortar to prepare a measurement sample. By using a Fourier transform infrared spectrophotometer-liquid nitrogen cooling detector ("Cray 670-IR" manufactured by Agilent Technologies, Inc.) and a heat diffuse reflection cell (manufactured by ST Japan INC.), the measurement sample was heated from room temperature to a predetermined temperature (120° C., 250° C., 300° C., 350° C., 400° C., 450° C.) at a rate of temperature rise of 10° C./min under the flow of a mixture gas of oxygen (20 vol %) and helium (80 vol %) (gas flow rate: 100 ml/min), followed by keeping the heating temperature at the predetermined temperature for 30 minutes to carry out thermally-stabilizing treatment. Then, the FT-IR absorption spectrum of the measurement sample after thermally-stabilizing treatment was measured. In addition, as a reference sample, the FT-IR absorption spectrum of calcium fluoride after the same thermally-stabilizing treatment was measured, and the FT-IR absorption spectrum of the measurement sample after the thermally-stabilizing treatment was subjected to the Kubelka-Munk conversion to determine the FT-IR absorption spectrum of the carbon material precursor after thermally-stabilizing treatment at each temperature (thermally-stabilized product). FIG. 6 illustrates the results.

As illustrated in FIG. 6, in the range of thermal-stabilization temperatures of 120 to 350° C., as the thermal-stabilization temperature increased, the thermal-stabilization reaction was found to be accelerated because the infrared absorption intensity resulting from the in-plane vibration of the six-membered ring structure (wave number: near 1180 to 1240 $cm^{-1}$) increased. Meanwhile, in the range of thermal-stabilization temperatures of 350 to 450° C., as the thermal-stabilization temperature increased, the infrared absorption intensity resulting from the in-plane vibration of the six-membered ring structure (wave number: near 1180 to 1240 $cm^{-1}$) decreased. This is conceivably because, in the range of thermal-stabilization temperatures of 350 to 450° C., as the thermal-stabilization temperature increased, the partial oxidation reaction was accelerated in addition to the thermal-stabilization reaction, which made it difficult for the six-membered ring structure produced by the thermal-stabilization reaction to be stably present.

In addition, calculated based on the results illustrated in FIG. 6 were the average value of the infrared absorption intensity (wave number: near 1180 to 1240 $cm^{-1}$) at each thermal-stabilization temperature (average infrared absorption intensity) and the ratio (infrared absorption intensity ratio) of the average value of infrared absorption intensity (wave number: near 1180 to 1240 $cm^{-1}$) at each thermal-stabilization temperature (average infrared absorption intensity) to the average value of the infrared absorption intensity (wave number: near 1180 to 1240 $cm^{-1}$) at a thermal-stabilization temperature of 120° C. (average infrared absorption intensity). Table 4 shows the results. Note that, when assuming the FT-IR absorption spectrum of the carbon material precursor subjected to thermally-stabilizing treatment at 120° C. is equivalent to the FT-IR absorption spectrum of the carbon material precursor before thermally-stabilizing treatment, the infrared absorption intensity ratio described above can be regarded as the infrared absorption intensity ratio (wave number: near 1180 to 1240 $cm^{-1}$) resulting from the in-plane vibration of the six-membered ring structure in the carbon material precursor before and after thermally-stabilizing treatment.

TABLE 4

| Thermal-stabilization temperature [° C.] | Average infrared absorption intensity*1 [a.u.] | Infrared absorption intensity ratio*1 |
|---|---|---|
| 120 | 0.97 | 1 |
| 250 | 1.10 | 1.13 |
| 300 | 1.63 | 1.67 |
| 350 | 1.69 | 1.74 |
| 400 | 1.46 | 1.50 |
| 450 | 1.25 | 1.29 |

*1Wave number of 1180 to 1240 $cm^{-1}$

As shown in Table 4, at a thermal-stabilization temperature of around 350° C., the average infrared absorption intensity (wave number: near 1180 to 1240 $cm^{-1}$) was found to be largest and the infrared absorption intensity ratio (wave number: near 1180 to 1240 $cm^{-1}$) was also found to be largest, 1.74. Therefore, it was found that, in the thermally-stabilizing treatment of the carbon material precursor, it is possible to obtain a thermally-stabilized product having a six-membered ring structure excellent in heat resistance by feedback-controlling the temperature in the electric tube furnace by using the concentration of water vapor as an index such that the generation of water vapor in the thermal-stabilization reaction of the carbon material precursor is completed and the generation of water vapor in the partial oxidation reaction is suppressed.

<Raman Spectroscopy>

A quartz boat (capacity of 2 ml) was filled with the dried AAm/AN copolymer powder (about 0.3 g) obtained in Synthesis Example 1 as a carbon material precursor, which was placed in a quartz tube (inner diameter of 16 mm) introduced in an electric tube furnace. While allowing the air to flow through the quartz tube (gas flow rate: 1000 ml/min), the carbon material precursor was heated from room temperature to 350° C. at a rate of temperature rise of 10° C./min, followed by keeping the heating temperature at 350° C. for 30 minutes to carry out thermally-stabilizing treatment.

Next, the temperature of the carbon material precursor after the thermally-stabilizing treatment (thermally-stabilized product) was reduced to room temperature. Then, while allowing a nitrogen gas to flow through the quartz tube (gas flow rate: 1000 ml/min), the thermally-stabilized product was heated from room temperature to 1100° C. at a rate of temperature rise of 20° C./min, followed by keeping the heating temperature at 1100° C. for 10 minutes to carry out carbonizing treatment.

Figure 7:
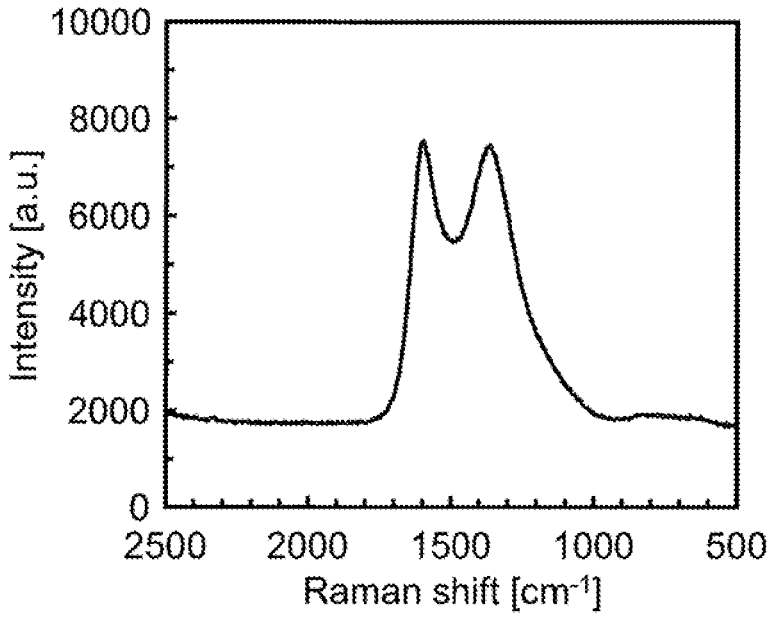
FIG. 7 is a graph illustrating a Raman spectrum of a carbon material obtained by thermally-stabilizing and then carbonizing the carbon material precursor formed of an acrylamide-based polymer obtained in Synthesis Example 1.

The Raman spectrum of the obtained carbon material was measured at room temperature using a laser Raman spectroscopic analyzer ("NSR-3300" manufactured by JASCO Corporation). FIG. 7 illustrates the results. In the Raman spectrum illustrated in FIG. 7, the peak near 1590 $cm^{-1}$ indicates the G-band originating from a graphite structure and the peak near 1350 $cm^{-1}$ indicates the D-band originating from a defective structure. The intensity ratio between the G-band and the D-band was calculated to be 1.01.

As described above, the present invention makes it possible to obtain a thermally-stabilized product excellent in heat resistance by controlling the thermal-stabilization temperature of the carbon material precursor by using the concentration of water vapor as an index such that the generation of water vapor in the thermal-stabilization reaction of the carbon material precursor is completed and the generation of water vapor in the partial oxidation reaction is suppressed. Therefore, the apparatus and the method for thermally-stabilizing a carbon material precursor of the present invention are useful as an apparatus and a method for obtaining a thermally-stabilized product which makes it possible to obtain a carbon material in a high yield.

What is claimed is:

1. An apparatus for thermally-stabilizing a carbon material precursor comprising:

a heating apparatus which thermally-stabilizes a carbon material precursor;

a temperature measuring means for measuring a temperature in the heating apparatus;

a water vapor concentration measuring means for measuring a concentration of water vapor in the heating apparatus; and a temperature control means for feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

2. The apparatus for thermally-stabilizing a carbon material precursor according to claim 1, wherein in the temperature control means, the temperature range between the temperature range where the generation of water vapor is accelerated in the thermal-stabilization reaction of the carbon material precursor and the temperature range where the generation of water vapor is accelerated in the partial oxidation reaction of the carbon material precursor is set to $T_1$ or more and $T_2$ or less, where a maximum value of the concentration of water vapor generated in the thermal-stabilization reaction of the carbon material precursor is denoted by $C_{max1}$ and a temperature corresponding to the maximum value is denoted by $T_{max1}$, a maximum value of the concentration of water vapor generated in the partial oxidation reaction of the carbon material precursor is denoted by $C_{max2}$ and a temperature corresponding to the maximum value is denoted by $T_{max2}$, a minimum value of the concentration of water vapor generated in a temperature range between $T_{max1}$ and $T_{max2}$ is denoted by $C_{min}$ and a temperature corresponding to the minimum value is denoted by $T_{min}$, a temperature where the concentration of water vapor takes a mean value of $C_{max1}$ and $C_{min}$ $(C_{max1}+C_{min})/2$, in a temperature range between $T_{max1}$ and $T_{min}$ is denoted by $T_1$, and a temperature where the concentration of water vapor takes a mean value of $C_{min}$ and $C_{max2}$ $(C_{min}+C_{max2}/2$, in a temperature range between $T_{min}$ and $T_{max2}$ is denoted by $T_2$.

3. The apparatus for thermally-stabilizing a carbon material precursor according to claim 2, wherein the temperature control means is a means for feedback controlling the temperature in the heating apparatus such that the concentration of water vapor in the heating apparatus is equal to or less than an average value of the concentration of water vapor in the temperature range between $T_1$ or more and $T_2$ or less.

4. A method for thermally-stabilizing a carbon material precursor which uses the thermal-stabilization apparatus according to claim 1, comprising the steps of:

measuring a temperature in the heating apparatus;

measuring a concentration of water vapor in the heating apparatus; and feedback-controlling the temperature in the heating apparatus by using the concentration of water vapor as an index such that generation of water vapor in a thermal-stabilization reaction of the carbon material precursor is completed and generation of water vapor in a partial oxidation reaction of the carbon material precursor is suppressed in a temperature range between a temperature range where the generation of water vapor is accelerated in the thermal-stabilization reaction and a temperature range where the generation of water vapor is accelerated in the partial oxidation reaction.

5. The method for thermally-stabilizing a carbon material precursor according to claim 4, wherein in the step of controlling the temperature, the temperature range between the temperature range where the generation of water vapor is accelerated in the thermal-stabilization reaction of the carbon material precursor and the temperature range where the generation of water vapor is accelerated in the partial oxidation reaction of the carbon material precursor is set to $T_1$ or more and $T_2$ or less, where a maximum value of the concentration of water vapor generated in the thermal-stabilization reaction of the carbon material precursor is denoted by $C_{max1}$ and a temperature corresponding to the maximum value is denoted by $T_{max1}$, a maximum value of the concentration of water vapor generated in the partial oxidation reaction of the carbon material precursor is denoted by $C_{max2}$ and a temperature corresponding to the maximum value is denoted by $T_{max2}$, a minimum value of the concentration of water vapor generated in a temperature range between $T_{max1}$ and $T_{max2}$ is denoted by $C_{min}$ and a temperature corresponding to the minimum value is denoted by $T_{min}$, a temperature where the concentration of water vapor takes a mean value of $C_{max1}$ and $C_{min}$, $(C_{max1}+C_{min})/2$, in a temperature range between $T_{max1}$ and $T_{min}$ is denoted by $T_1$, and a temperature where the concentration of water vapor takes a mean value of $C_{min}$ and $C_{max2}$ $(C_{min}+C_{max2}/2$, in a temperature range between $T_{min}$ and $T_{max2}$ is denoted by $T_2$.

6. The method for thermally-stabilizing a carbon material precursor according to claim 5, wherein in the step of controlling the temperature, the temperature in the heating apparatus is feedback-controlled such that the concentration of water vapor in the heating apparatus is equal to or less than the average value of the concentration of water vapor in the temperature range between $T_1$ or more and $T_2$ or less.

* * * * *